US012703527B2

(12) United States Patent
Fukuda et al.

(10) Patent No.: US 12,703,527 B2
(45) Date of Patent: Aug. 11, 2026

(54) VARIABLE RESERVOIR DEVICE

(71) Applicant: HellermannTyton GmbH & Co. KG, Tornesch (DE)

(72) Inventors: Taro David Fukuda, Hamburg (DE); Andreas Schwinn, Hamburg (DE)

(73) Assignee: HELLERMANNTYTON GmbH, Tornesch (DE)

( * ) Notice: Subject to any disclaimer, the term of this patent is extended or adjusted under 35 U.S.C. 154(b) by 400 days.

(21) Appl. No.: 18/048,375

(22) Filed: Oct. 20, 2022

(65) Prior Publication Data

US 2023/0131919 A1 Apr. 27, 2023

(30) Foreign Application Priority Data

Oct. 21, 2021 (DE) ..... 20 2021 105 775.0
Feb. 7, 2022 (DE) ..... 20 2022 100 676.8
Mar. 9, 2022 (DE) ..... 20 2022 101 283.0

(51) Int. Cl.
*B65B 13/02* (2006.01)

(52) U.S. Cl.
CPC ..... *B65B 13/027* (2013.01)

(58) Field of Classification Search
CPC ..... B65B 13/02; B65B 13/025; B65B 13/027; B65B 13/16; B65B 13/18; B65B 13/184; B65B 13/185; B65B 13/187; B65B 13/345; B65B 59/003; B25C 1/003; B65D 63/1027
USPC ..... 140/93.2, 123; 206/338, 340, 347, 442; 439/590
See application file for complete search history.

(56) References Cited

U.S. PATENT DOCUMENTS 3,258,819 A 7/1966 Weckesser
3,537,146 A 11/1970 Caveney
3,900,922 A 8/1975 Mccormick
(Continued)

FOREIGN PATENT DOCUMENTS

CN 110127101 8/2019
CN 110127102 8/2019
(Continued)

OTHER PUBLICATIONS

"Extended European Search Report", EP Application No. 22202483.8, Apr. 25, 2023, 7 pages.
(Continued)

*Primary Examiner* — Christopher L Templeton
*Assistant Examiner* — P Derek Pressley
(74) *Attorney, Agent, or Firm* — Colby Nipper PLLC

(57) ABSTRACT

The disclosure relates to a reservoir device for feeding one-piece fixing ties, OPTs, to an automatic bundling tool device, ABT, wherein the reservoir device is configured to detachably hold the OPTs on at least one carrier unit of the reservoir device, in a row, with the carrier unit having a base and being configured to be moved to or through the ABT in order to have the OPTs detached from the carrier unit; where the at least one carrier unit is a unit separate from the OPTs; and the at least one carrier unit is configured to have the respective OPT detachably attached to the carrier unit by a respective interface element configured to receive and hold the respective OPT on the carrier unit so as to enable a flexible feeding of different types of one-piece fixing ties to automatic bundling tool devices.

15 Claims, 4 Drawing Sheets

(56) References Cited

U.S. PATENT DOCUMENTS

| | | | | |
|---|---|---|---|---|
| 4,269,379 | A | 5/1981 | Mccormick | |
| 4,371,011 | A | 2/1983 | Hidassy | |
| 4,495,972 | A | 1/1985 | Walker | |
| 4,498,506 | A | 2/1985 | Moody et al. | |
| 4,557,023 | A | 12/1985 | Six et al. | |
| 4,735,387 | A | 4/1988 | Hirano et al. | |
| 4,805,856 | A | 2/1989 | Nicoli et al. | |
| 5,205,328 | A | 4/1993 | Johnson | |
| 5,386,615 | A | 2/1995 | Bernard | |
| 5,759,004 | A | 6/1998 | Kuffel | |
| 5,799,375 | A | 9/1998 | Fukami | |
| 6,009,997 | A | 1/2000 | Deschenes et al. | |
| 6,029,814 | A * | 2/2000 | Ohuchi | B21J 15/323 411/443 |
| 6,112,499 | A | 9/2000 | Lyskawa et al. | |
| 6,244,899 | B1 * | 6/2001 | Bogursky | H01R 12/57 439/937 |
| 6,279,620 | B1 | 8/2001 | Eason et al. | |
| 6,347,435 | B1 | 2/2002 | Davignon et al. | |
| 6,530,126 | B2 | 3/2003 | Caveney | |
| 6,533,226 | B2 | 3/2003 | Geiger | |
| 6,640,839 | B2 * | 11/2003 | Thieme | B65B 13/345 140/123 |
| 7,278,188 | B2 | 10/2007 | Kurmis | |
| 7,661,633 | B2 | 2/2010 | Igarashi et al. | |
| 8,281,461 | B2 | 10/2012 | Geiger | |
| 12,258,156 | B2 | 3/2025 | Fukuda et al. | |
| 2002/0084388 | A1 | 7/2002 | Geiger | |
| 2007/0023586 | A1 | 2/2007 | Geiger | |
| 2008/0250609 | A1 | 10/2008 | Franks | |
| 2010/0306967 | A1 | 12/2010 | Geiger | |
| 2016/0280405 | A1 | 9/2016 | Thieme et al. | |
| 2019/0106231 | A1 | 4/2019 | Schwinn et al. | |
| 2019/0144149 | A1 | 5/2019 | Dohrmann et al. | |
| 2019/0248521 | A1 | 8/2019 | Hillegonds et al. | |
| 2020/0156224 | A1 | 5/2020 | Suenaga | |
| 2020/0339329 | A1 | 10/2020 | Xu | |
| 2020/0391891 | A1 * | 12/2020 | Xu | B65B 13/16 |
| 2023/0126004 | A1 | 4/2023 | Fukuda et al. | |
| 2023/0349491 | A1 | 11/2023 | Fish | |

FOREIGN PATENT DOCUMENTS

| | | | | |
|---|---|---|---|---|
| CN | 209921662 | | 1/2020 | |
| CN | 111071527 | | 4/2020 | |
| CN | 111071628 | A | 4/2020 | |
| DE | 3382610 | | 4/1993 | |
| DE | 69313329 | | 3/1998 | |
| DE | 202004018890 | | 2/2005 | |
| EP | 3712076 | | 9/2020 | |
| EP | 3747781 | | 12/2020 | |
| FR | 2429921 | | 1/1980 | |
| JP | H0285574 | U | 7/1990 | |
| JP | H0789510 | A | 4/1995 | |
| JP | 3642861 | B2 | 2/2005 | |
| KR | 200431100 | | 11/2006 | |
| WO | 2005099402 | | 10/2005 | |
| WO | 2019051624 | | 3/2019 | |
| WO | WO-2019149253 | A1 * | 8/2019 | B65B 13/027 |

OTHER PUBLICATIONS

"Extended European Search Report", EP Application No. 23179733.3, Nov. 13, 2023, 7 pages.
"Final Office Action", U.S. Appl. No. 12/478,863, filed Apr. 11, 2012, 10 pages.
"Non-Final Office Action", U.S. Appl. No. 12/478,863, filed Jul. 18, 2021, 9 pages.
"Notice of Allowance", U.S. Appl. No. 12/478,863, filed Aug. 20, 2012, 8 pages.
"Restriction Requirement", U.S. Appl. No. 12/478,863, filed May 17, 2021, 7 pages.
"Restriction Requirement", U.S. Appl. No. 18/048,189, Jun. 5, 2024, 6 pages.
"Undated Button Head Tie Product", Apr. 24, 2013, 3 pages.
"Non-Final Office Action", U.S. Appl. No. 18/048,189, Nov. 7, 2024, 9 pages.
"Notice of Allowance", U.S. Appl. No. 18/048,189, Jan. 22, 2025, 7 pages.
"Extended European Search Report", EP Application No. 22202471.3, Sep. 12, 2023, 16 pages.

* cited by examiner

VARIABLE RESERVOIR DEVICE

INCORPORATION BY REFERENCE

This application claims priority to German Utility Model Number 202022101283.0, filed Mar. 9, 2022, German Utility Model Number 202022100676.8, filed Feb. 7, 2022, and German Utility Model Number 202021105775.0, filed Oct. 21, 2021, the disclosures of which are incorporated by reference in their entireties.

BACKGROUND

In an automatic bundling tool device, ABT, usually a single type of cable tie, or, more generally speaking, a single type of one-piece fixing tie, is processed. Depending on the type of tool device, different methods are used to store and provision cable ties and also to insert a respective cable tie into the tool device. All methods have in common that there is an external supply of cable ties outside of the tool device, from which single cable ties are extracted for further processing. Currently, there are three main methods in industrial use to store and provision cable ties:

A) Loose cable ties are stored and provisioned in an external, usually vibrational, feeder system and shot into the tool device through e.g. a feeding hose and/or a channel by a pressurised air, comparable to a blow gun.

B) Cable ties are pre joined and provisioned as a bandoleer and processed in an external feeder system, which isolates a single cable tie, which is then, similar to method A), shot into a tool through e.g. a feeding hose and/or a channel via pressurised air.

C) Cable ties are pre joined and provisioned as a bandoleer, which is inserted directly into the tool device, where the single cable ties are cut off the bandoleer for further processing by the tool device itself.

Exemplary methods for feeding an automatic bundling tool are, for example, described in US2020/391891A1 or CN110127101A.

CN209921662U discloses a feeding, distributing, and pushing mechanism of a binding tool, which comprises an intermittent indexing mechanism, a distributing mechanism, pushing mechanism, and a slider mechanism. Sequentially, the intermittent indexing mechanism conveys one binding tape to the working position of the material distribution mechanism at a time, the material distribution mechanism separates the binding tape from the binding tape connecting plate of the integrated binding type, and the material pushing mechanism pushes the separated binding tape into the sliding block for positioning, the slide block mechanism slides the binding tape from the pre-positioning position to a binding working position; after the binding is finished, the head part of the binding tape exits from the side block and the slide block retreats from the binding working position to the pre-positioning position, the intermittent indexing mechanism. The described automatic bundling tool can be used to fix either a labelled cable tie or a regular cable tie with a regular head part shape.

Usually, however, automatic bundling tool devices and feeding devices, that is, the tie supply, will be optimised for a certain type of cable tie or, more generally speaking, for a certain type of one-piece fixing tie, OPT—this in order to reduce complexity, minimise process tolerances, and maximise reliability during automatic application of the respective cable tie or OPT. In general OPTs may also be referred to as integrated fixed cable tie with irregular head shapes. Thus, simple cable ties may be considered a subgroup of OPTs.

SUMMARY

It hence can be considered an objective technical problem to be solved by the disclosed apparatuses and methods to overcome the problems of the known state-of-the-art and enable a flexible feeding of different types of one-piece fixing ties to automatic bundling tool devices.

This problem is solved by the subject matter of the independent claims. Advantageous embodiments are apparent from the dependent claims, the description, and the figures.

One aspect relates to a reservoir device for feeding one-piece fixing ties, OPTs, to an automatic bundling tool device, ABT. As the OPTs may be of one or more given types, where the OPTs belonging to different types differ in foot part geometry and/or neck part geometry and/or head part geometry and/or tail part geometry, the reservoir device may be referred to as a variable reservoir device. Generally speaking, the OPTs as a generalised concept of a standard cable tie, which has a cable tie head part with a window, as well as a cable tie strap or tail part, which is slid through the window in order to form a loop which can be used to bundle cables or alike, one-piece fixing ties also comprise a neck part, which connects a foot part to the head part, where the foot part comprises some sort of fixing means, for instance a mushroom head part, that can be used to fix the OPT to an object, for instance in an hole of the object.

Consequently, the OPT shape or geometry is generally more complex and, due to the different foot parts, there is much more variability from type to type as compared to standard cable ties. This makes processing of different OPTs more complex, which is not possible with current methods. In general, the interface between any kind of storage or reservoir device or provisioning/feeding device and tool device poses a difficulty which increases with the number of variants of the processed OPTs. For example, OPTs with different foot part geometries generally cannot be shot through the same feeding hose. In addition, unlike standard cable ties, OPTs are currently sold mainly as loose material, loose OPTs, and, consequently, are not pre joined by e.g. a bandoleer. Loose OPTs are more difficult to handle as they initially have no predefined orientation which would help inserting them into a tool device or feeding device. Bandoleer attached OPTs are rather uncommon and offered only in a small number of variants. They are also more expensive as compared to bulk material, loose OPTs, as for every different bandoleer/tie variant, a new injection mould is required. Furthermore, storing and provisioning of OPT bandoleers is problematic due to their large size and handling issues. In particular, due to their flexibility in all spatial directions, they can easily deform and get entangled one with another.

Consequently, the reservoir device is configured to detachably hold the OPTs, which are single or loose OPTs, on at least one carrier unit of the reservoir device in a row, independently of the ABT. In said row, the OPTs preferably all have the same orientation with respect to the at least one carrier unit associated with the respective OPT. The carrier unit has a base, which may be a cuboid body or have a shape similar to a cuboid. Furthermore, the carrier unit is configured to be moved, e.g. pushed and/or pulled, to or through the ABT in order to have the OPTs detached from the carrier unit by the ABT or a feeding device configured for feeding the OPTs held by the reservoir device to the ABT.

The at least one carrier unit is a unit separate from the OPTs, so it is not materially joined with the respective OPTs. Consequently, the OPTs are loose OPTs and the reservoir device, as well as carrier unit are configured for feeding and holding said loose OPTs. As a consequence, the at least one carrier unit is configured to have the respective OPT, the loose OPT, detachably attached to the carrier unit by a respective interface element of the respective carrier unit which is configured to receive and hold the respective OPT on said carrier unit. In order to attach the respective OPT on said carrier unit, it is moved into/onto the interface element in an insertion direction. Preferably, the at least one carrier unit is configured to hold the OPT by its head part and/or its neck part and/or its foot part.

So, the problem of storing and provisioning highly varying OPTs, especially with regards to their foot parts, is solved by a variable reservoir capable of holding and releasing different loose OPTs used in the storage and provisioning process individually. Such a variable reservoir can be integrated into a feeding unit, which guides the reservoir device and comprises a mechanism designed to stepwise move the reservoir device and release one OPT at a time from the flexible reservoir for transfer, for instance, to an associated automatic bundling tool device. Consequently, this gives the advantage of a reusable reservoir device, which allows to use individual loose OPTs of different types, that is, different geometries, in particular different foot part geometries and/or different neck part geometries and/or different head part geometries. The different types of OPTs can even be held in the reservoir device at the same time, as described in more detail below, leading to a reservoir device where OPTs with different shapes, i.e. of different types, can be provided in a given order to the automatic bundling tool device.

In an example embodiment, the reservoir device comprises a multitude of carrier units that are linked or connected to each other via a mechanical connection interface with a predetermined number of degrees of freedom, DOF, for spatial movements of two adjacent carrier units linked to each other, with respect to each other. So, the individual carrier units form a reservoir device similar to a chain, where the individual members of the chain are flexible with respect to each other. Therein, each carrier unit, preferably is configured to hold exactly one OPT. The mechanical connection interface may also comprise a flexible or elastic member which exerts a resetting spring force that acts to move each carrier unit back into a resting or neutral position with respect to the adjacent carrier unit. For instance, this can be realised by one or more elastic bands connecting the adjacent carrier units.

The mechanical connection interface may comprise additional parts in between two adjacent carrier units, but preferably is formed by elements of the carrier units themselves, as described in more detail part below. So, the problem of a sequential storage of OPTs, even of OPTs of different geometries or types, is solved by designing the reservoir device as a combination of individual units, links, that are attached to each other, where each individual unit can hold an OPT. Consequently, similar to a chain, the individual carrier units may, as also described in more detail below, themselves be optimized for OPTs with different shapes, i.e. have interface elements with different geometries adapted to a respective type, that is, a specific geometries of the OPT to be held by the carrier unit at hand The chain-like design of the reservoir device allows an ever individual assembly of combinations of different carrier units as parts of the reservoir device, thus further enhancing flexibility of the reservoir device.

Accordingly, in an example embodiment, the mechanical connection interface is a unified or standardised mechanical connection interface comprising first- and second-type connection elements. The unified mechanical connection interface is configured to link adjacent carrier units by linking a first-type connection element of one carrier unit to a second-type connection element of another carrier unit. In particular, the first-type connection elements are male connection elements with a protrusion such as a finger or a ball, and the second type connection elements are female connection elements accepting the male connection elements with a recess such as a gap, which may be formed between two fingers or by a socket. For example, the fingers of the male connection element and the fingers of the female connection element forming the recess for accepting the finger may feature respective holes perpendicular to the respective fingers, and thus might be connected by inserting a pin through all three fingers, thereby forming a joint with one rotational DOF. As an alternative, the finger of the male connection element may comprise a pin-shaped contour which substitutes the pin, so that no additional part is needed. The ball or sphere-shape protrusion of another example male connection element matched to a semi-sphere socket of a corresponding female connection element would result in a kind of ball-and-socket joint with multiple DOF. The mechanical connection interface may also comprise combinations of the described elements or variations of said elements, and may generally be adjusted to achieve the desired degrees of freedom. This further enhances the flexibility and range of applications of the described reservoir device.

In an example embodiment, each carrier unit has one first-type connection element, in particular exactly one first-type connection element, and one second-type connection element, in particular, exactly one second-type connection element, with the first-type connection element and second-type connection element arranged at opposite ends, in particular diametrically opposite ends, of the respective carrier unit, in particular at opposite ends of the base of the respective carrier unit along the direction of the row. Here and in the following, the reference to respective ends, may be interpreted as a reference to respective end sections that are separated by a middle section. This has been shown to be particular advantageous for designing the connections between the carrier units in such a way that they offer a predetermined degree of freedom, for example, only one rotation degree around one axis, in a way that the row or chain of carrier units does not entangle, i.e. can be handled more easily, and can be guided in defined way. With this setup, even multiple degrees of freedom, in particular in combination with a resetting spring force such as an elastic bumper element as part of the mechanical connection interface can be implemented in order to enable a reliable and flexible feeding of OPTs.

In an example embodiment, each carrier unit comprises a unified guiding structure, preferably with at least two guiding elements such as pins or other types of protrusion. In particular, the guiding elements are arranged at opposite ends, in particular diametrically opposite ends, of the base of the respective carrier units across the direction of the row formed by the linked carrier units, i.e. across a longitudinal direction of the reservoir device. Most preferably, the unified guiding structure comprises four guiding elements with the guiding elements being arranged pairwise at each of the opposite ends, i.e. two guiding elements on each respective side of the carrier unit. In addition or alternatively, the guiding elements may be in form of a unified recess of the base at said opposite ends, preferably diametrically opposite ends of the base of the respective carrier unit across the direction of the role. In addition or alternatively, the guiding elements are provided in form of one or more unified spatial dimensions of the base, for instance a unified length along the direction of the row and/or a unified width across the direction of the row and/or a unified thickness across the direction of the row, perpendicular to the width. The unified guiding structure allows a feeding device, such as the feeding device described below in more detail, to guide the reservoir device to the ABT. The reference to unified entities such as the unified mechanical connection interface and the unified guiding structure refers to entities that are identical, that is, compatible, for different carrier units even when they belong to different classes of carrier units, i.e. are optimized for different OPTs. So, all carrier units can be used with the same feeding device, and thus can also be combined with each other without degrading reliability of the feeding process. Thus, the flexibility of the reservoir device is further enhanced.

In an example embodiment, each carrier unit comprises a unified conveyor structure, preferably with two conveyor elements such as a conveyor protrusion extending from the base. In particular, the conveyor elements are arranged on the base of the carrier oppositely to the interface element, that is, on a side of the base arranged oppositely to the side of the base where the interface element is arranged, in particular diametrically oppositely. The side may also be referred to as bottom of the base, as opposed to the top of the base where the interface element is arranged then. This gives the advantage that all carrier units may interact with a conveyor mechanism of the feeding device, with, for example a pawl which interlocks with said conveyor structure to shift the carrier units by a predetermined distance and/or angle to the next position towards the APT. As all carrier units have the same conveyor structure, the flexibility of the feeding process is maintained, while reliability is increased.

In another example embodiment, the interface element of each carrier unit comprises two protrusions, a first protrusion and a second protrusion, that extend from the base of the respective carrier unit, in particular perpendicular to a base surface of said base, which may be a surface of on the top of the base. The two protrusions form a recess, that is, an opening or gap, between the protrusions that is configured for accommodating the respective OPTs. In particular, the recess/two protrusions are configured to accommodate the head part of the OPT and/or the foot part of the OPG and/or the neck part of the OPP, the neck part connecting head part and foot part. Furthermore, the interface element may comprise another protrusion, a third protrusion, that extends from the base, in particular perpendicular to the base surface, where the third protrusion is configured to support the OPT when it is held on the carrier. Consequently, the third protrusion is shaped to match with the foot part of the OPT, in particular in a remote end section of the third protrusion, that is, the end section that comprises the end of the protrusion remote from the base in a direction perpendicular to said base surface.

Said protrusions, which also can be referred to as vertical protrusions on the top of the base of each carrier unit realise an individual mechanical interface matched to a certain type of OPT. In particular, first and second protrusions may be parallel, meaning that their respective inner faces forming at least part of the recess run essentially parallel (parallel or parallel with a given deviation of e.g. less than 10°, less than 5°, or less than) 1°. Occasionally, geometric similarities between certain types of OPTs, for instance OPTs with similar or identical head parts but different foot parts, the same individual interface element may even be useful for holding different types of OPTs. However, in particular in combination with a unified mechanical connection interface, the use of said protrusions gives the possibility to attach OPTs of different types to the reservoir device, which even can, by sorting the different carrier units of different types in a specific order, be fed in said order to the ABT for a flexible, process design where different types of OPTs are to be used consecutively. This is particularly advantageous for an ABT that can handle the different types of OPTs, but might also be used with a feeding device, where different ABTs are connected to the reservoir device consecutively in order to bundle different parts with different APTs. Consequently, the flexibility of the feeding process is further advanced.

Therein, the two protrusions may be configured to clamp, with their inner faces, the head part of the respective OPT and/or the neck part of the respective OPT by means of an elastic pre-load acting on two opposed side surfaces of the head part of the OPT and/or onto opposed side surfaces of the foot part of the OPT and/or on two opposed side surfaces of the neck part of the OPT. Consequently, the two protrusions exert a clamping force on the OPT with their inner faces. In addition or alternatively, the two protrusions may be configured to form-fit to the head part of the OPT, preventing motion of the OPT along a main extension plane of the base of the respective carrier unit. The two protrusions may be designed in a way that the opening or recess between them is slightly smaller than the head part of the OPT to be inserted into the opening during intended use of the reservoir device, so that the head part spreads the protrusions apart and thereby creates said clamping force due to elastic deformation. Thus, the clamping force may run transvers to the insertion direction.

Consequently, the two protrusions can be made from a material which offers a desired degree of elasticity so that the required clamping force can be achieved. For instance, the protrusions and/or the carrier unit, which may be made of one single piece, may be made of plastic. This gives the advantage that the problem of the irregular orientation of loose OPTs is solved, since the contour provided by the two protrusions with their inner faces is adjusted to the specific OPT to be used, and thus helps to compensate for misalignments of the OPT by acting on the respective surfaces of the OPT and thereby rotating/shifting the OPT into the correct position. This further enhances the flexibility of the described reservoir device.

Furthermore, the two protrusions may comprise a respective hook section at a respective remote end of the protrusion, which is the end of the end section remote from the base of the active carrier unit in a direction antiparallel to the insertion direction of the OPT into the recess between the two protrusions. Therein, the hook sections reduce a width of the recess formed by said protrusions such that the hook sections secure OPTs held by the carrier unit from unintended release. So, the hook sections have a geometry facing inward to the recess and thus fixing the head part and/or foot part of the OPT in the recess, once it is arranged in said recess, with a corresponding fixing force running along the insertion direction. By means of the hook sections, a clip-in solution can be provided, where the OPTs can be clipped into or onto the respective carrier unit. Correspondingly, the geometry facing inward can comprise an undercut.

In another example embodiment, each carrier unit belongs to one of several different carrier unit types, where the different carrier unit types are each adapted to a specific type of OPT, i.e. to a specific OPT geometry, which differs in foot part and/or head part and/or neck part from the geometry other types of OPTs. Preferably, at least two carrier units of the reservoir device belong to respective different carrier unit types. So, each carrier unit is individually matched to one type of OPT by adjusting the shape of the first and second protrusion according to the different geometries of the OPTs intended to be fed held the reservoir device. Consequently each carrier unit can accommodate a specific OPT in an optimal way. So each carrier unit is adapted to detachably hold an OPT of a specific type. This results in a specifically flexible reservoir device, where OPTs belonging to different types can be selected to be fed by the feeding device in an order defined by the order of the carrier units of the corresponding types in the row of carrier units which form or are part of the reservoir device. Again, flexibility of the reservoir device is increased while reliability of the feeding process is maintained.

Therein, the carrier units of the different carrier unit types may be configured such that respective windows of the head parts of different OPTs which are held by any two subsequent carrier units of different carrier unit type, carrier units of different carrier unit type that are arranged subsequently on the reservoir device and/or in the row, are equidistant for any combination of the different carrier unit types. The distance may be measured along the row in a resting position of the carrier units, i.e. along the longitudinal direction of the reservoir device. In addition or alternatively, said windows are arranged in a line along the row, i.e. they have the same position in a lateral direction perpendicular to the longitudinal direction. The lateral direction may also be the main extension direction of the OPTs. So, the first and second protrusion is placed, for any carrier unit, in a way that the OPT head part window is always located in the same longitudinal and/or lateral position with regards to the carrier unit with attached OPT, so that there is a similarity between all individual carrier unit with attached OPT with regard to the window location, regardless of the respective type of OPT the carrier unit is optimized for. This solves the problem of interfacing between the ABT and the feeding device feeding the ABT with OPTs from the reservoir device, as for any different OPTs, the respective windows are in the same relative longitudinal position and may thus be handed over to the ABT reliably. This is particularly true in combination with the unified mechanical connection interface and/or the unified guiding structure. Then, also the different carrier units of the reservoir device may always be, prior to the release of the OPT, in a same predefined position relative to the feeding unit. Therefore, during the feeding process, process complexity is reduced, and reliability of the flexible feeding process is further enhanced.

Another aspect relates to a feeding device for or with a reservoir device of any of the precedent claims, configured to feed the OPTs to the ABT. The feeding device comprises a guiding slot unit configured to guide the reservoir device through the feeding device, preferably by a mechanical interaction with the unified guiding structure of the respective carrier units. The feeding device also comprises a stepwise conveyor mechanism unit configured to stepwise move the reservoir device along the guiding slot unit, by one position at the time, where the step width of the stepwise movement, the position, corresponds to a carrier unit length along the reservoir device, i.e. along a main extension direction of the reservoir device. Preferably, the stepwise conveyor mechanism is configured to stepwise move the reservoir device by a mechanical interaction with the unified conveyor structure of the respective carrier units. Furthermore, the feeding device comprises an actuator unit configured to eject or release of the respective OPT from the reservoir device, preferably by a mechanical interaction with the head part of the OPT. So, the described approach for sequential storage and provisioning OPTs may incorporate a feeding unit which holds and guides a part of the variable reservoir device and comprises a mechanism to stepwise move the variable reservoir and release OPTs from the reservoir for transfer to e.g. an automatic bundling tool. Advantages correspond to advantages of the example embodiments of the reservoir device as described above.

Preferably, the individual carrier units with attached cable ties may be moved freely in the guiding slot by the stepwise conveyor mechanism unit. To this end, the guiding slot may have a slit configured for the straps of the OPTs extending through the slit into an environment of the feeding device. So, the feeding device may have a housing in which part of the reservoir device is guided while another part of the reservoir device may be hanging freely outside of the housing. The housing may comprise a semicircular shaped part, which part comprises the slit extending along the semicircular shape. Thus, the slit of the guiding slot may be a ring segment. Alternatively, the corresponding part of the housing may be shaped linearly, where the slit of the guiding slot would be straight. A forward and/or backward stop of the stepwise conveyer mechanism unit may be provided to protect against unintended movement of the reservoir device relative to the feeding device. So, flexible and reliable feeding of a variety of OPTs can be provided for working environments with different working conditions.

The actuator unit may comprise an actuator which, with a linear movement, extends and pushes an OPT out of the corresponding carrier unit, against the clamping force and the fixing force of the inward facing protrusions, until it reaches a desired position, e.g. a position in an associated automatic bundling tool. Preferably, the actuator features a defined protrusion, which is configured to enter the OPT head part window to safely hold the OPT when it is pushed into the ABT. The actuator may also comprise additional protrusions that are designed to be in contact with the OPT head part and/or foot part while pushing the OPT in order to have a defined stop and insertion depth of the actuator with respect to the OPT.

Another aspect relates to an automatic bundling tool device, ABT with any of the described reservoir devices or with any of the described feeding devices. The advantages correspond to advantages described for the respective feeding and reservoir devices.

Such an ABT for bundling a bundling good by means of an OPT, preferably with automatically tightening the OPT by the ABT, may be a non-stationary ABT. In particular, the ABT is configured for bundling a bundling good by means of a cable tie, preferably with automatically tightening the cable tie by the ABT.

The ABT may comprise a holding unit configured to receive, hold, and release a respective OPT which is provided to the ABT from the described variable external reservoir device for OPTs, which preferably is configured to provide OPTs of different types of OPTs to the ABT, most preferably in an order that can be arbitrarily adapted to the application at hand The ABT preferably also comprises a linear motion guiding unit configured to linearly guide the holding unit in a forward/backward direction while in motion back and forth between a receiving position where the holding unit receives, during intended use, the respective OPT that is processed by the ABT at the time, and a releasing position where the holding unit releases, during intended use, said OPT. The forward/backward direction corresponds to a main extension direction of the OPT, with a tip of the strap part oriented in the forward direction and the head part of the OPT oriented in the backward direction. The linear motion guiding unit enables low friction guiding of the holding unit and allows for high process speeds. The ABT then comprises a drive unit configured to move the holding unit along the linear motion guiding unit.

Therein, the holding unit preferably comprises two gripping elements which are arranged movably on a common base element such that they can be moved in a traverse direction running traverse to the forward/backward direction. Here and in the following, "traverse" may refer to "essentially perpendicular", i.e. "perpendicular" or "perpendicular with a given deviation" where the deviation may be, for instance less than 5°, less than 2°, or less than 1°. Each gripping element has a respective gripping contour for accommodating the respective OPT to be received, held, and released during intended use of the ABT. The contour is thus specifically adapted to the respective OPTs to be processed by the ABT. Each gripping element is configured to be moved, in a translational movement in the traverse direction, from an open position for receiving and releasing the respective OPT to a closed position for holding the respective OPT and vice versa. In the open position, a distance between the two gripping elements is larger than in a closed position. Thus, the OPT can be placed in/removed from between the gripping elements. The contours may, at least partly, surround head part and/or neck part and/or foot part of the respective OPT in the closed position to hold the OPT with the holding unit, in particular in a form-fit manner Preferably in both releasing and receiving position of the holding unit, the holding unit may be set into a locked configuration with the gripping elements in the closed position and into an unlocked configuration, where the gripping elements are in the closed position.

So, the ABT is capable of processing highly variant OPTs by implementing a new gripping and transport mechanism. Instead of a conventional flexible pusher acting on the back of a cable tie head or the foot of the OPT, or using a slider with a receiving portion fitted to one single type of OPT, a set of two movable gripping jaws, acting traverse the forward/backward direction is used to firmly hold the OPT head and/or foot part in place, i.e. in a given position relative to the base element. The gripping jaws, implemented in form of gripping elements, are arranged on the base element that is linearly driven forward, i.e. from receiving position to releasing position, in the forward/backward direction to drive the OPT's strap part forward, for example into guiding claws of the ABT to forming a loop around the bundle.

As each gripping element is movable traverse the forward/backward direction, the gripping elements basically realize an in and out movement. This in and out movement makes it possible to receive even large-size OPT foot parts by opening the gripping jaws, inserting an OPT and then closing the jaws so that they surround or enclose the OPT head part and/or foot part, preferably in a form-fit manner. Furthermore, as the gripping elements are in mechanical contact with the OPT, in particular OPT head part and/or neck part and/or foot part, by closing the gripping jaws, side rotations, that is, small irregularities concerning the orientation of OPTs, especially loose OPTs, are automatically corrected, as the closing gripping elements during their movement into the closed position are capable of automatically rotating and/or shifting the respective OPT into the correct position. The firm hold of the gripping elements on the OPTs, in particular head part and/or neck part and/or foot part, ensures that the head and neck and foot part, respectively, do not move during forward motion, thereby reducing the risk of the strap tip diverging sideward from the linear movement during forward movement to the releasing position. This spares the need of a tight guiding channel around the OPT required in other approaches, thus enabling to process a larger variety of OPTs than in conventional ABTs. Summarizing, the parallel gripper implemented by the two gripping elements enable holding, transporting, and releasing of multiple variants of (even loose) one-piece fixing ties fed to the ABT by the variable reservoir device described above.

Correspondingly, a further aspect relates to a carrier unit for or of a reservoir device of any of the described embodiments. Correspondingly, the respective carrier unit comprises the features described in the context of the complete reservoir device that are relevant for the respective carrier unit. Advantages and advantageous embodiments correspond to the advantages and advantageous embodiments described for the reservoir device.

Yet another aspect relates to a method for feeding one-piece fixing ties, OPTs, to an automatic bundling tool device, ABT, with the method steps of attaching one or more loose of OPTs to a respective carrier unit of a reservoir device, holding the attached OPTs individually on the reservoir device by the respective carrier unit, pulling the reservoir device to the ABT by a feeding device, detaching the OPTs, one by one, from the respective carrier unit by an actuator unit of the feeding device, and feeding the respective detached OPT to the ABT by the feeding device.

Also here, advantages and advantageous embodiments of the method correspond to advantages and advantageous embodiments described with reference to the reservoir device, the feeding device, and the automatic bundling tool device.

In the context of the present disclosure, "transverse" and "along" can be understood to mean "substantially perpendicular" and "substantially parallel", respectively. Here, "substantially perpendicular" or "substantially parallel" means "perpendicular/parallel except for a specified deviation", wherein the specified deviation may be, for example, 2°, 5°, 10° or 15°.

The features and combinations of features mentioned in the description herein, including in the introductory part, as well as the features and combinations of features mentioned below in the description of the figures and/or shown in the figures can be used not only in the respectively specified combination, but also in other combinations without departing from the scope of the disclosure. Thus, embodiments which are not explicitly shown in the figures and explained but which emerge from the explained embodiments by separate combinations of features, and which can be produced, are also to be regarded as included and disclosed. Embodiments and combinations of features which therefore do not contain all the features of an originally formulated independent claim are also to be regarded as disclosed. In addition, embodiments and combinations of features which go beyond or deviate from the combinations of features set out in the dependencies of the claims are to be regarded as disclosed, in particular by the embodiments discussed above.

BRIEF DESCRIPTION OF THE DRAWINGS

The subject matter according to the disclosure will be explained in greater detail with reference to the schematic drawings shown in the following figures, but without being limited to the specific embodiments shown here. In the drawings.

Therein, identical or functionally identical features have the same reference signs.

DETAILED DESCRIPTION

The present disclosure relates to a reservoir device for feeding one-piece fixing ties, OPTs, of one or more given types to an automatic bundling tool device, ABT, with the reservoir device being configured to detachably hold the OPTs on at least one carrier unit of the reservoir device, in a row, where the carrier unit has a base and is configured to be moved to or through the ABT in order to have the OPTs detached from the carrier unit.

Figure 1:
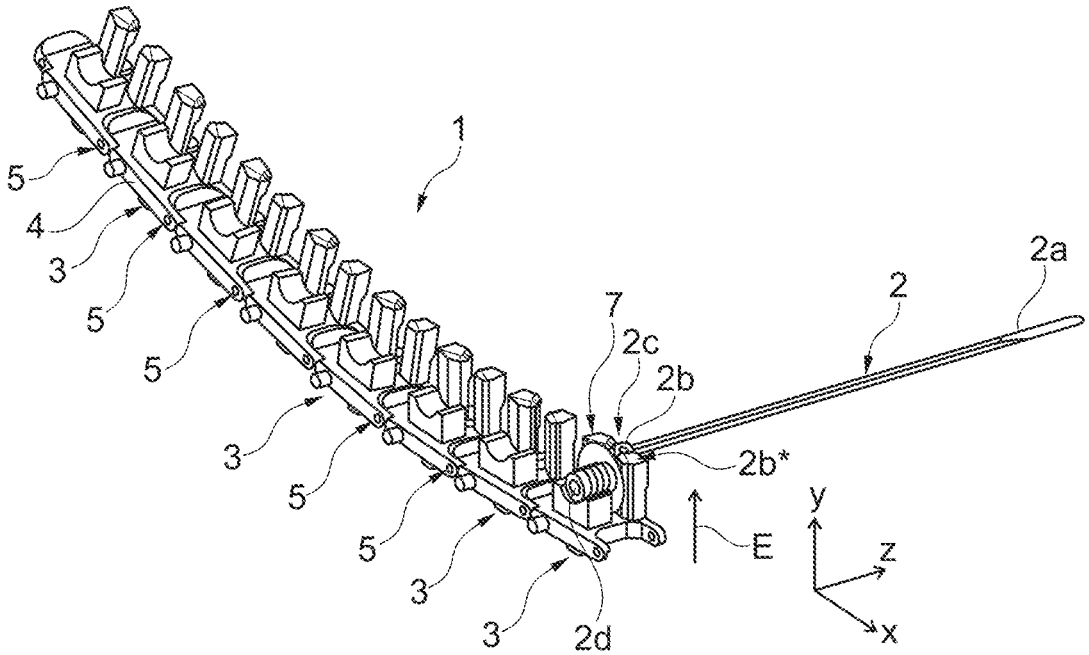
FIG. 1 shows an example embodiment of a reservoir device.
Figure 8:
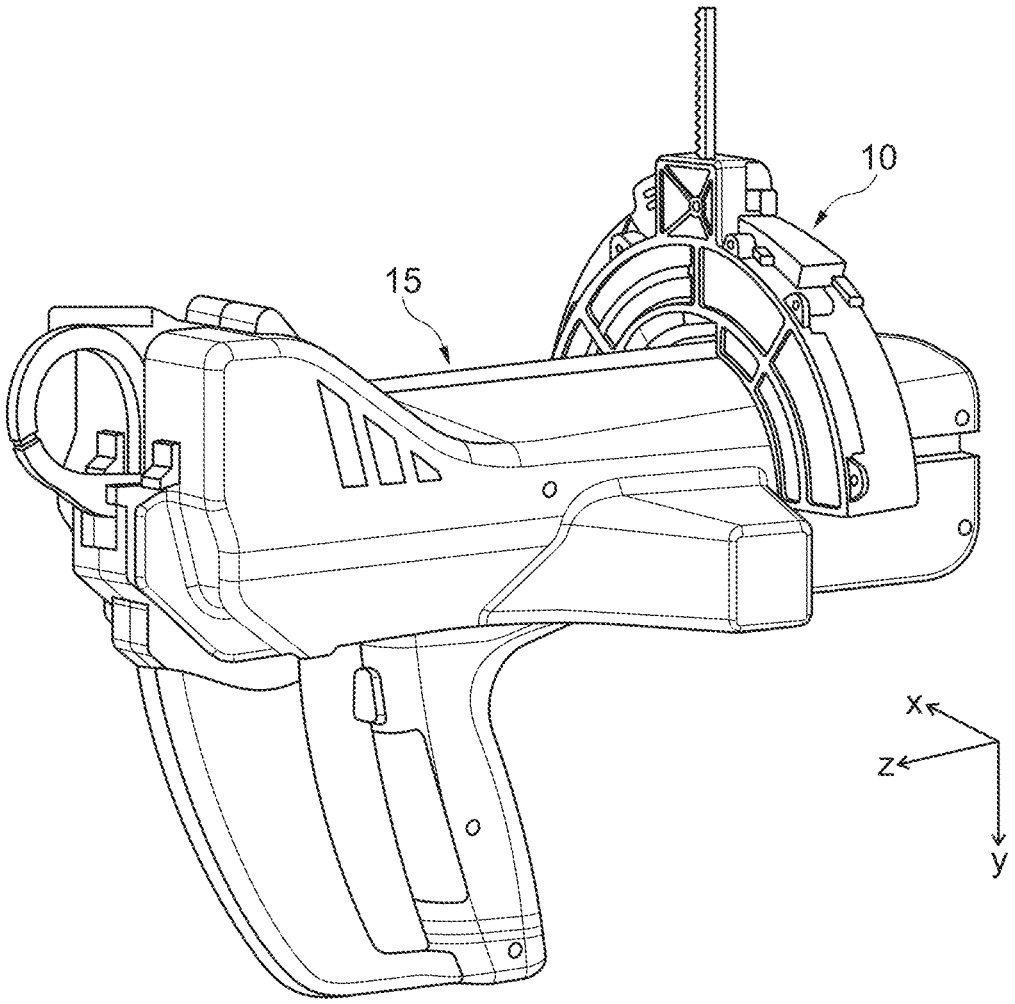
FIG. 8 shows the feeding device of the FIGS. 4 to 7 arranged on an example automatic bundling tool device.

FIG. 1 shows an example reservoir device 1 for feeding one-piece fixing ties 2, OPTs 2, to an automatic bundling tool device, ABT 15 (FIG. 8). The reservoir device 1 is configured to detachably hold the OPTs 2 on at least one carrier unit 3, in the present example a multitude of carrier units 3. The carrier units 3 are aligned in a row that, in the present example, mainly extends along an x-direction as longitudinal direction. As each carrier unit 3 is configured to detachably hold exactly one OPT 2 in the present example, also the OPTs 2 are held in a row corresponding to the row of the carrier units 3. The carrier units 3 are configured to have the respective OPT 2 detachably attached to the carrier unit 3 by a respective interface element 7 configured to receive and hold the respective OPT 2 on the carrier unit 3. Consequently, carrier units 3 and the respective OPTs 2 held by the associated carrier units 3 are separate units. The carrier unit 3 has a base 4 which is configured to be pulled to or through the ABT 15 in order to have the OPTs 2 detached from the carrier unit. The detaching takes place in an ejection direction E transverse to the longitudinal direction of the row.

The OPTs 2 comprise a tail part 2*a*, a head part 2*b* with a window 2*b, a neck part 2***c* and a foot part 2*d*, where the neck part 2*c* connects the head part 2*b* to the foot part 2*d*. The tail part 2*a* is configured to be slid through and arrested in the window 2*b**, so as to form a loop that can be used to bundle goods.

The carrier units 3 are linked to each other via a, in the present example unified, mechanical connection interface 5 with a predetermined number of degrees of freedom for spatial movements of two adjacent carrier units 3 linked to each other with respect to each other by said connection interface 5. In the present example, the degree of freedom is one. In the present example, the mechanical connection interface 5 comprises first and second type connection elements 5*a*, 5*b*, as explained in more detail with respect to FIG. 2.

Figure 2:
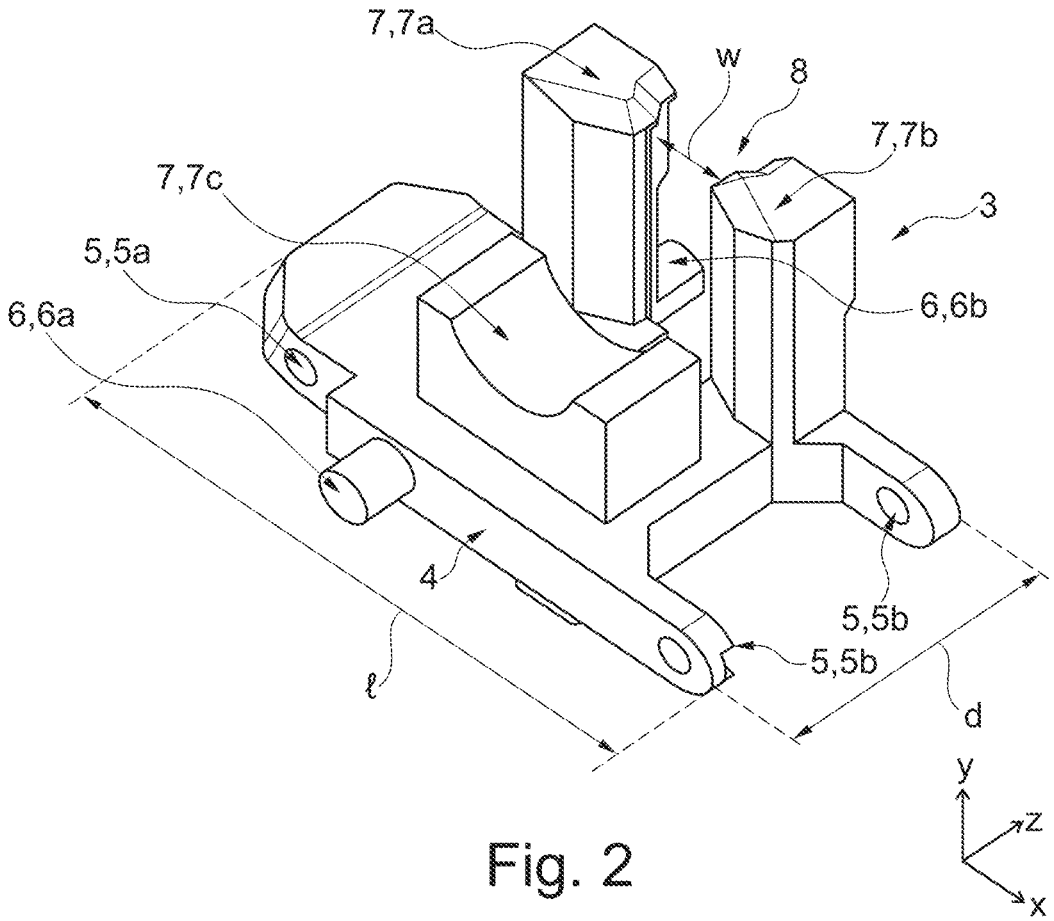
FIG. 2 shows an example embodiment of one of a multitude of carrier units of an example reservoir device.

FIG. 2 shows an example embodiment of a single carrier unit 103. The shown example comprises male first-type connection elements 105*a* and female second-type connection elements 5*b* that are arranged at opposite ends of the carrier unit 103, here at opposite sense of the base 104 of the respective carrier unit 103 in the longitudinal direction of the carrier unit 103, which is also the (main extension) direction of the row, the x-direction the present example. Here, the male first-type connection element 105*a* has a finger as protrusion and the corresponding female second-type connection element 5*b* has two fingers forming a corresponding recess accepting the finger of the male connection element 105*a*. These connection elements 105*a*, 5*b* are identical for all carrier units 103 of the reservoir device, and thus can be referred to as a unified mechanical connection interface 105. In the present example, the resulting link between two adjacent carrier units 103 gives flexibility in a depth direction (y-direction) perpendicular to the longitudinal direction (x-direction).

In the present example, each carrier unit 3 also comprises a unified guiding structure 6, here, with two pins as respective guiding elements 6*a*, 6*b*. They are, the present example, arranged at opposite ends of the base 4 in z-direction. It is also shown that the carrier units 3 have unified spatial dimensions, the unified width d and unified length 1, such that length 1 and width d are identical for all carrier units 3 of a given reservoir device 1. This, together with the guiding elements 6*a*, 6*b* makes the feeding process more reliable.

Furthermore, the interface element 7 comprises a first protrusion 7*a* and a second protrusion 7*b* that extend from the base 4 in a vertical direction, and the present example transverse to a base surface, in the positive y-direction. In between the two protrusions 7*a*, 7*b* a recess 8 is formed by the two protrusions 7*a*, 7*b*. Recess 8 is configured to accommodate the respective OPT 2, in particular a head part 2*b* and/or a neck part 2*c*, in the present example of the OPT 2. In the present example, the interface element 7 also comprises another protrusion, third protrusion 7*c*, that is configured to support the foot part 2*d* of OPT 2 in the present example.

Figure 3:
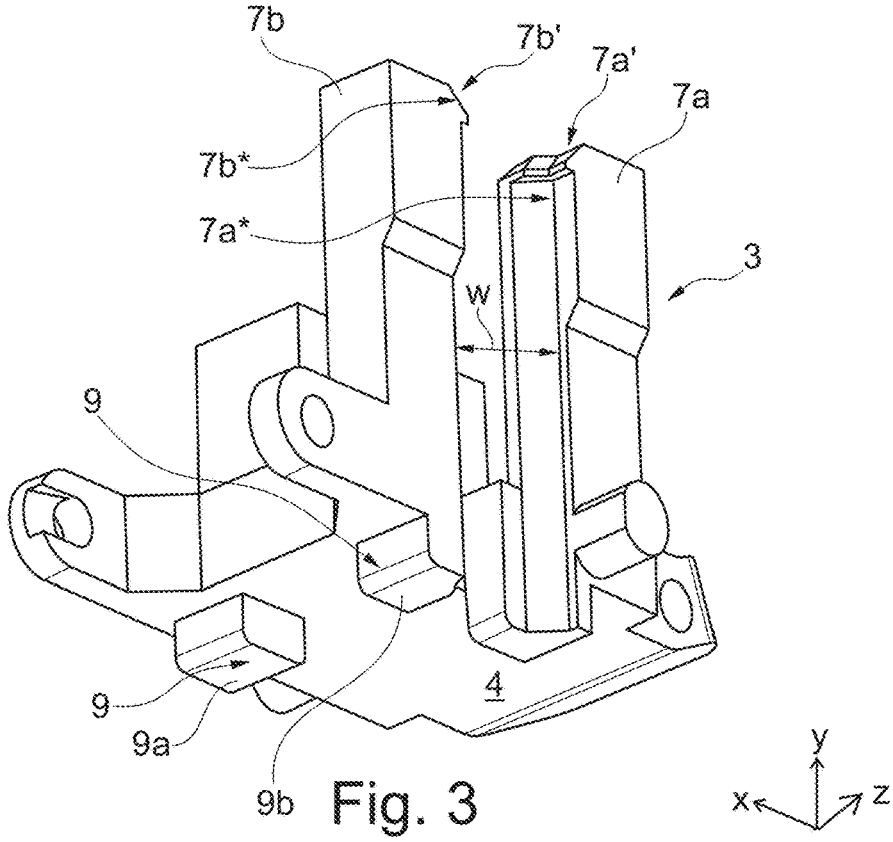
FIG. 3 shows another view on the example carrier unit of FIG. 2.

FIG. 3 shows another perspective of the carrier unit 3 of FIG. 2. The carrier unit 3 also comprises a unified conveyor structure 9, with, in the present example, two conveyor protrusions as respective conveyor elements 9*a*, 9*b* extending from the base 4 at a bottom side, that is, here a side oriented towards the negative y-direction, of said base 4. In the shown example, the first and second protrusions 7*a*, 7*b* comprise respective hook sections 7*a, 7*b at respective remote ends 7*a*', 7*b*' being the ends most remote from the base 4 of the respective carrier unit 3. The hook sections 7*a, 7*b reduce a width w of the recess 8 in the x-direction, which is adapted to the corresponding width of the head part 2*b* in the present example, such that the hook sections 7*a, 7*b secure an OPT 2 that is held by the carrier unit 3 from unintended release.

Figure 4:
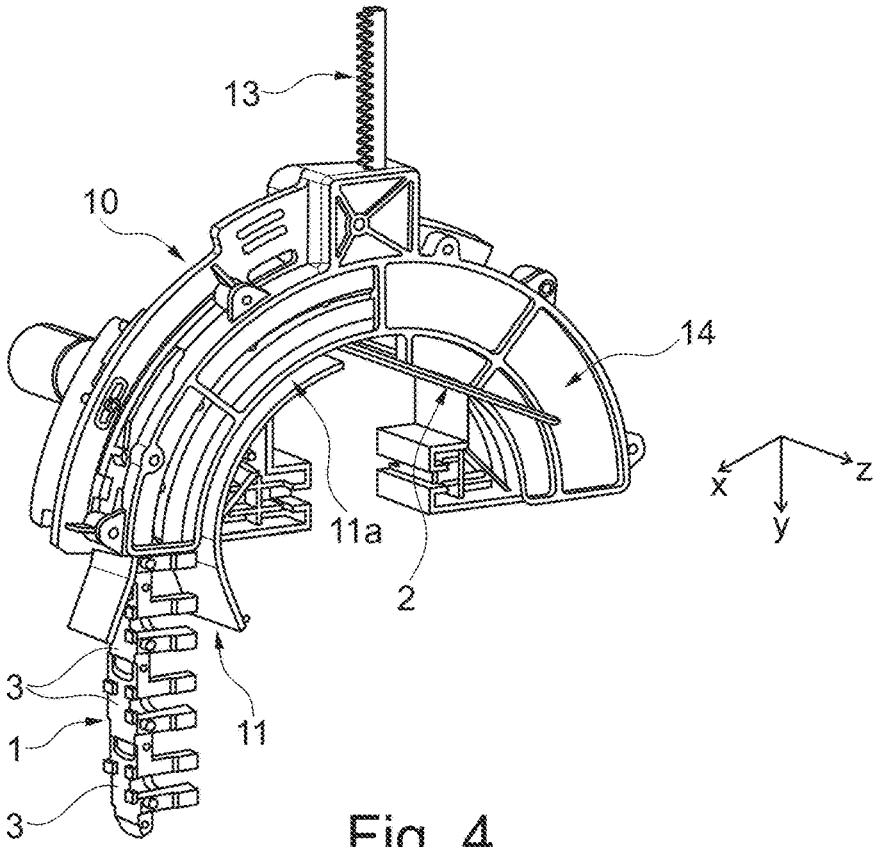
FIG. 4 shows an example feeding device with an example reservoir device.

FIG. 4 shows a feeding device 10 with a guiding slot unit 11 configured to guide the reservoir device 1 through the feeding device 10, in the present example by a mechanical interaction with the unified guiding structure 6. The feeding device 10 also comprises a stepwise conveyor mechanism unit configured to stepwise move the reservoir device 1 along the guiding slot unit 11, preferably by a mechanical interaction with the unified conveyor structure 9. Furthermore, the feeding device 10 comprises an actuator unit 13 configured to eject the respective OPT 2 from the reservoir device 1. In the present example in a positive y-direction is the ejection direction E. The ejection or release is accomplished, in the present example, by a mechanical interaction with the head part 2*b* of the OPT 2, as shown in more detail part in FIGS. 5 to 7.

Figure 5:
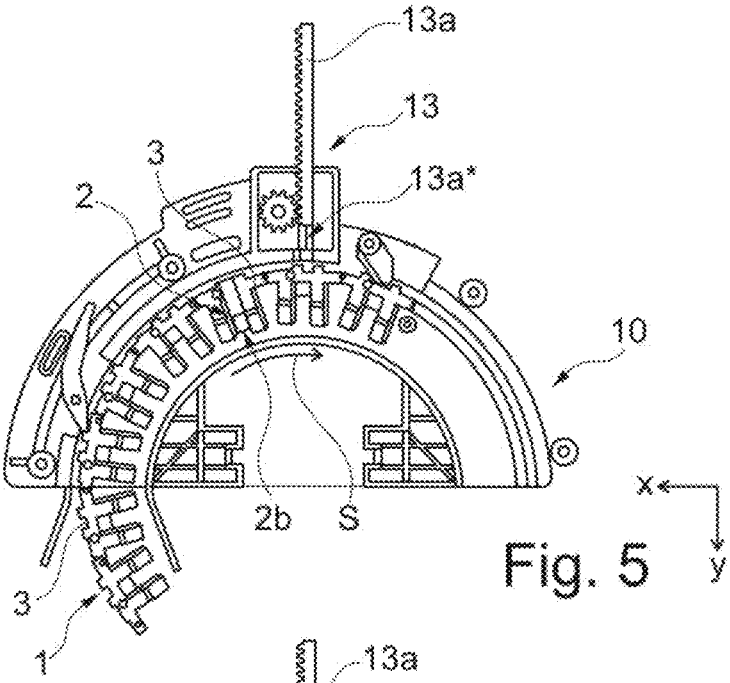
FIGS. 5 to 7 illustrate the process of feeding a one-piece fixing ties by the feeding device of FIG. 4.
Figure 6:
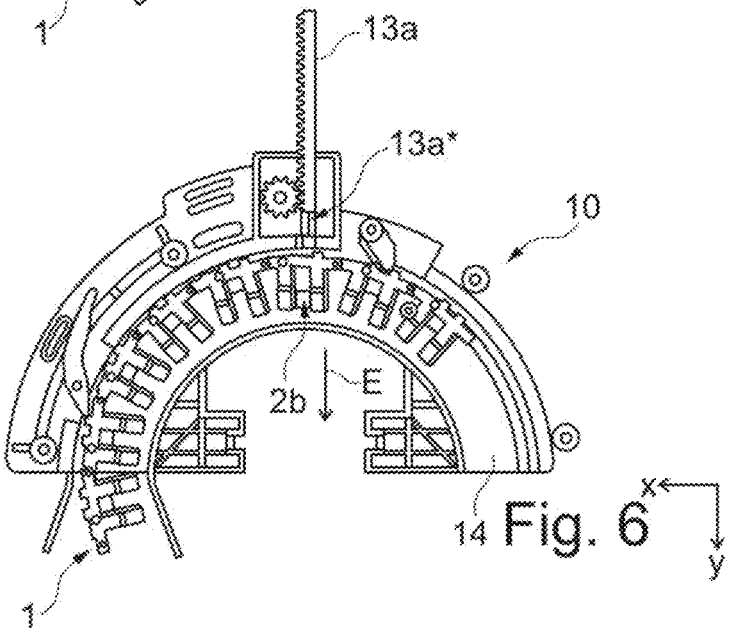
Figure 7:
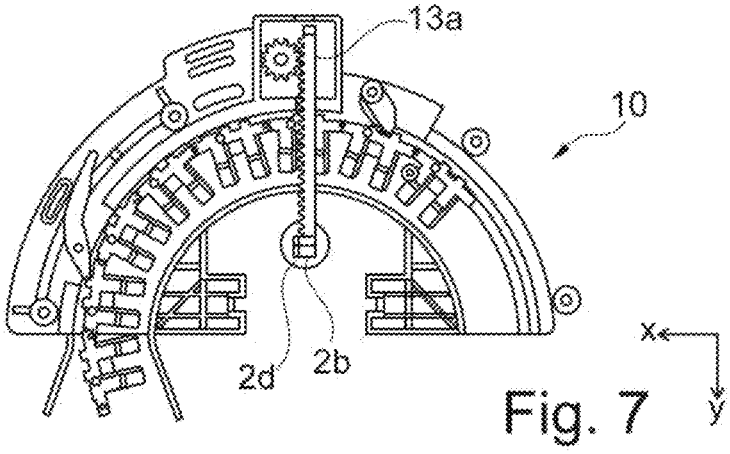

As shown in FIGS. 5 to 7, the actuator unit 13 comprises an actuator bolt 13*a* that is moved, the present example, linearly in the ejection direction E, here the positive y-direction in order to detach the OPT 2 from carrier unit 3. Note that the actuator bolt 13*a* comprises a protrusion 13*a configured to match the window 2*b of the head part 2*b* of the OPT 2.

In FIG. 5, the reservoir device 1 is guided through the feeding device 10 by the guiding slot unit 11, with, for illustrative purposes only, one single OPT 2 held by a carrier unit 3 of the feeding device 1. The guiding slot unit (11) has a slit (11*a*) configured for a tail part (2*a*) of the OPT (2) extending through the slit (11*a*) into an environment of the feeding device (10). The carrier unit 3 with the OPT 2 is not yet in a position where the OPT 2 may be ejected towards the ABT 15, thus the reservoir device 1 is first moved stepwise in the stepping direction S to align the actuator bolt 13*a*, in particular, the actuator finger as protrusion 13*a, with the window 2*b of the OPT 2 to be ejected. The alignment is achieved in FIG. 6. Once the actuator bolt 13*a* with its protrusion 13*a is aligned with the window 2*b of the OPT 2, the reservoir device 1 is stopped in this position, and the actuator bolt 13*a* moves in the ejection direction E and ejects the OPT 2 from the reservoir device 1 and the housing 14 of the feeding device 10 to the ABT 15. The ABT 15 is shown in FIG. 8 with the feeding device 10 attached and ready to use with the reservoir device 1.

With the described approach, it is possible to store and provision loose OPTs for further processing, e.g. in an ABT. Formerly, it was only possible to store and provision standard cable ties (loose or on a bandoleer) with slightly varying shape or OPTs on a bandoleer for the use in available ABTs. The limitation to process only one type of OPT, or very similar types of OPT can now be removed so that multiple types of OPTs can be stored and provisioned. The known bandoleer can now be replaced by a variable reservoir similar to a chain, consisting of individual holding elements, the carrier units, where each carrier unit can be fitted to a certain type of cable tie and may be freely combined with different other carrier units. Different OPTs, including even standard cable ties, can now be stored and provided in a defined sequential manner, e.g. a fir-tree-foot-part OPT followed by an edge-clip-foot-part OPT and/or OPTs with varying lengths in between, thereby offering a higher degree of flexibility in the manufacturing of cable harnesses with an ABT.

The use of "example," "advantageous," and grammatically related terms means "serving as an example, instance, or illustration," and not "preferred" or "advantageous over other examples." Items represented in the accompanying figures and terms discussed herein may be indicative of one or more items or terms, and thus reference may be made interchangeably to single or plural forms of the items and terms in this written description. The use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"), unless the context clearly dictates otherwise. Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, c-c-c, or any other ordering of a, b, and c).

What is claimed is:

1. A reservoir device for feeding loose one-piece fixing ties (OPTs), the loose OPTs each including a cable tie head part with a window, a strap part, a neck part connecting a foot part to the head part, and a foot part with a fixing connector, to an automatic bundling tool device (ABT), the reservoir device comprising:

a plurality of carrier units linked to each other via a unified mechanical connection interface, the plurality of carrier units comprising at least two different carrier unit types, each carrier unit type of the two carrier unit types configured to hold exactly one OPT and structurally adapted to a specific type of the loose OPT that differs in at least one part of the foot part, the head part, or the neck part, wherein the reservoir device is configured to detachably hold the OPTs on the respective carrier units, in a row, with the carrier units having a base and being configured to be moved to or through the ABT in order to have the OPTs detached from the carrier unit, wherein the carrier unit is a unit separate from the OPTs and is not materially joined with the respective OPT and configured to hold loose OPTs, and wherein the carrier unit is structurally configured to have the respective loose OPT detachably attached to the respective carrier unit by a respective interface element configured to receive, hold, and release the respective loose OPT on the carrier unit by providing a form fit for the head part of the respective OPT preventing motion of the OPT along a main extension plane of the base of the respective carrier unit and a form fit for support of the foot part of the OPT when it is held on the carrier unit, and to secure the OPTs from unintended release such that the reservoir device is a reusable reservoir device, wherein the unified mechanical connection interface comprises a male protrusion connection element arranged on an end of the carrier unit base and a female recess connection element arranged on an opposite end of the carrier unit base and is configured to link adjacent carrier units by linking the male protrusion connection element of one carrier unit to the female recess connection element of another carrier unit with a predetermined number of degrees of freedom for spatial movements of two adjacent carrier units linked to each other with respect to each other.

2. The reservoir device according to claim 1, wherein the male protrusion connection element further comprises a finger or a ball, and wherein the female recess connection element further comprises a gap or a socket.

3. The reservoir device according to claim 1, wherein each carrier unit comprises:

a unified guiding structure, the unified guiding structure comprising at least two guiding elements arranged at least one of:

at opposite ends of the base of the respective carrier unit;

in form of a unified recess defined in the base; or in form of unified spatial dimensions of the base.

4. The reservoir device according to claim 1, wherein each carrier unit comprises:

a unified conveyor structure, wherein the unified conveyor structure comprises two conveyor elements extending from the base, the conveyor elements arranged on the base oppositely to the interface element.

5. The reservoir device according to claim 1, wherein the interface element comprises:

two protrusions that extend from the base that define a recess configured for accommodating the respective OPT; and another protrusion that extends from the base that is configured to support the OPT when it is held on the carrier unit.

6. The reservoir device according to claim 5, wherein the two protrusions are configured to at least one of:

clamp a head part of the respective OPT by means of an elastic pre-load acting on two opposed side surfaces of the head part of the OPT; or provide a form fit for the head part of the OPT preventing motion of the OPT along a main extension plane of the base of the respective carrier unit.

7. The reservoir device according to claim 5, wherein the two protrusions comprise a respective hook section at a respective remote end, which is the end remote from the base of the respective carrier unit, the hook sections reducing a width of the recess defined by the protrusions such that the hook sections secure OPTs held by the carrier unit from unintended release.

8. The reservoir device according to claim 1, wherein each carrier unit of the plurality of carrier units belongs to a carrier unit type of several different carrier unit types, where the different carrier unit types are each adapted to a specific type of OPT which differs in at least one of a foot part, a head part, or a neck part from the other types of OPT.

9. The reservoir device according to claim 8, wherein the carrier units of the different carrier unit types are configured such that respective windows of the head parts of different OPTs which are held by two subsequent carrier units of different carrier unit type are at least one of:

equidistant for any combination of the different carrier unit types; or arranged on a straight line parallel to a direction of main extension of the reservoir device.

10. A system comprising:

a reservoir device for feeding loose one-piece fixing ties (OPTs), the loose OPTs each including a cable tie head part with a window, a strap part, a neck part connecting a foot part to the head part, and a foot part with a fixing connector, to an automatic bundling tool device (ABT), the reservoir device comprising a plurality of carrier units, comprising at least two different carrier unit types, each carrier unit type of the two carrier unit types structurally adapted to a specific type of the loose OPT that differs in at least one part of the foot part, the head part, or the neck part, wherein the reservoir device is configured to detachably hold the loose OPTs on the carrier unit, in a row, with the carrier unit having a base and being configured to be moved to or through the ABT in order to have the loose OPTs detached from the carrier unit, wherein the carrier units are units separate from the OPTs, and wherein the carrier units are configured to have the respective loose OPT detachably attached to the respective carrier unit by a respective interface element configured to receive and hold the respective loose OPT on the respective carrier unit by providing at least one of a form fit for the head part of the respective OPT preventing motion of the OPT along a main extension plane of the base of the respective carrier unit or a form fit for support of the foot part of the OPT when it is held on the carrier unit, and to secure the OPTs from unintended release;

a feeding device configured to feed the loose OPTs to the ABT, with a guiding slot unit configured to guide the reservoir device through the feeding device;

a stepwise conveyor mechanism unit configured to stepwise move the reservoir device along the guiding slot unit; and an actuator unit configured to eject the respective loose OPT from the reservoir device holding the respective loose OPT.

11. The system according to claim 10, wherein the actuator unit is configured to eject the respective OPT from the reservoir device by a mechanical interaction with a head part of the OPT.

12. The system according to claim 10, wherein each carrier unit comprises:

a unified guiding structure, the unified guiding structure comprising at least two guiding elements, wherein the guiding slot unit is configured to guide the reservoir device through the feeding device by a mechanical interaction with the unified guiding structure.

13. The system according to claim 10, wherein each carrier unit comprises:

a unified conveyor structure, wherein the unified conveyor structure comprises two conveyor elements extending from the base, the conveyor elements arranged on the base oppositely to the interface element, wherein the reservoir device is stepwise moved along the guiding slot unit by mechanical interaction with the unified conveyor structure.

14. The system according to claim 10, wherein the feeding device is configured to feed the OPTs to the ABT, with a guiding slot unit configured to guide the reservoir device through the feeding device, guiding slot unit comprising a slit configured for a tail part of the OPTs extending through the slit into an environment of the feeding device.

15. A method for feeding loose one-piece fixing ties (OPTs) to an automatic bundling tool device (ABT), comprising:

attaching one or more loose OPTs to one of a plurality of respective carrier units of a reservoir device, the plurality of carrier units comprising at least two different carrier unit types, each carrier unit type of the two carrier unit types structurally adapted to a specific type of the loose OPT, the loose OPTs each including a cable tie head part with a window, a strap part, a neck part connecting a foot part to the head part, and a foot part with a fixing connector, the types of loose OPT differ in at least one part of the foot part, the head part, or the neck part, where the respective carrier units are flexible with respect to each other by being linked to each other via a mechanical connection interface with a predetermined number of degrees of freedom for spatial movements of two adjacent carrier units;

holding the attached OPTs individually on the reservoir device by the respective carrier unit;

pulling the reservoir device to the ABT by a feeding device, detaching the OPTs, one by one, from the respective carrier unit by an actuator unit of the feeding device; and feeding the respective detached OPT to the ABT by the feeding device.

* * * * *